US006691905B2

(12) United States Patent
Berdan

(10) Patent No.: US 6,691,905 B2
(45) Date of Patent: Feb. 17, 2004

(54) DETACHABLE MULTI-MOUNTING COMPACT GOLF ACCESSORY ORGANIZER

(76) Inventor: Greg S. Berdan, 2310 Arthur Nate Haugh Dr., Tracy, CA (US) 95377

( * ) Notice: Subject to any disclaimer, the term of this patent is extended or adjusted under 35 U.S.C. 154(b) by 0 days.

(21) Appl. No.: 09/976,064

(22) Filed: Oct. 15, 2001

(65) Prior Publication Data

US 2003/0071096 A1 Apr. 17, 2003

(51) Int. Cl.[7] ..... B65D 25/10; B65D 85/00

(52) U.S. Cl. ..... 224/183; 206/315.1; 206/486; 206/818; 224/245; 224/269; 224/666; 224/679; 224/918

(58) Field of Search ..... 224/183, 199, 224/235, 240, 241, 242, 245, 269, 666, 679, 918; 206/315.1, 486, 488, 579, 818

(56) References Cited

U.S. PATENT DOCUMENTS

| | | | | | |
|---|---|---|---|---|---|
| 2,536,725 | A | * | 1/1951 | Cleveland | 206/315.1 |
| 2,797,806 | A | * | 7/1957 | Davis | 206/486 |
| 3,298,579 | A | * | 1/1967 | Smith | 224/183 |
| 3,753,519 | A | * | 8/1973 | Gammon | 206/486 |
| 4,151,937 | A | * | 5/1979 | Jarosh et al. | 224/666 |
| 4,736,877 | A | * | 4/1988 | Clark | 224/666 |
| 4,804,121 | A | | 2/1989 | Stanton et al. | |
| 4,993,614 | A | | 2/1991 | Bonofiglo | |
| 5,199,573 | A | * | 4/1993 | Gribovsky | 206/579 |
| 5,269,410 | A | | 12/1993 | Abregano | |
| 5,312,029 | A | * | 5/1994 | Tuber | 224/679 |
| 5,642,809 | A | * | 7/1997 | Mayville | 206/579 |
| D393,948 | S | | 5/1998 | Cowlen | |
| 5,799,853 | A | * | 9/1998 | Brewster | 224/679 |
| 5,934,530 | A | * | 8/1999 | Antczak et al. | 224/245 |
| 6,102,201 | A | * | 8/2000 | Marston et al. | 206/315.1 |
| 6,202,911 | B1 | | 3/2001 | Freer | |
| 6,209,766 | B1 | * | 4/2001 | Kwon | 224/269 |

* cited by examiner

*Primary Examiner*—Gary E. Elkins
(74) *Attorney, Agent, or Firm*—Robert L. Epstein; Harold James; James & Franklin, LLP

(57) ABSTRACT

A compact golf accessory organizer with a multi-mounting, universal functioning clip, which can attach to several different items. The common items for attachment include a golfer's golf bag, golf cart visor, clothing waistband, belt, pockets, and the like. The compact organizer contains a vac-form with impressions that mold around the included articles. This is specifically designed to only hold the following articles: four tees, two ball markers, and a universal tool which consists of a divot repair, a spike tightening device, a club cleaner and cigar holder. These items are included in the golf accessory organizer. The compact size of the organizer allows it to be stored in a golfer's shirt or pant pocket, or the user can attach it to their waistband without obstructing the golfers swing. This organizer will free up the golfers pockets and conveniently organize the common items used during the game of golf.

11 Claims, 5 Drawing Sheets

FIG. 1
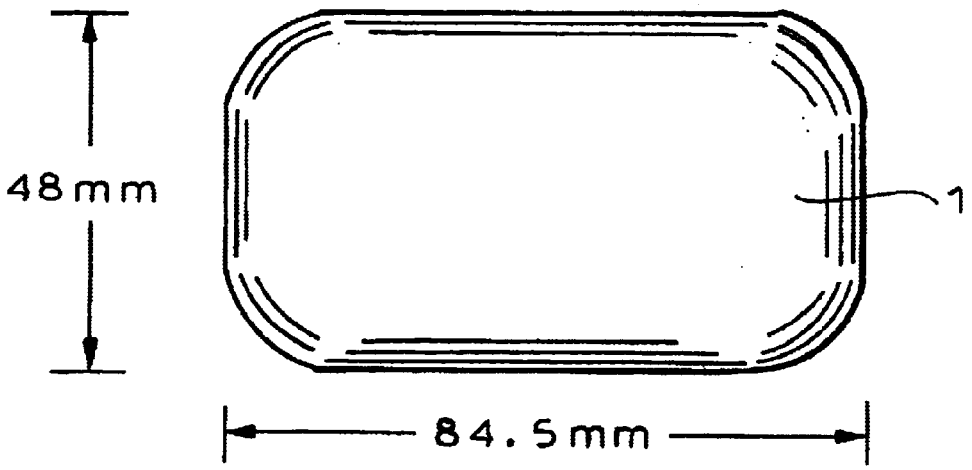
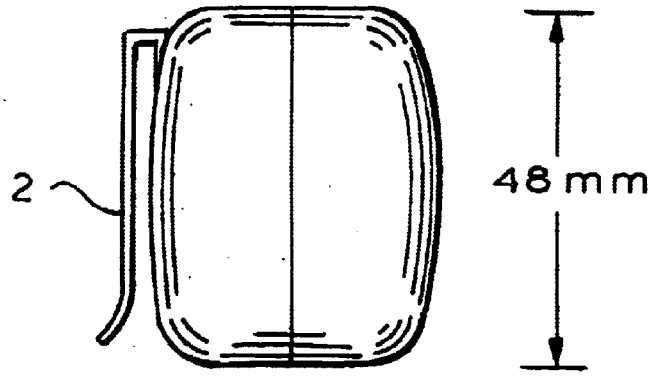
FIG. 2

FIG. 3
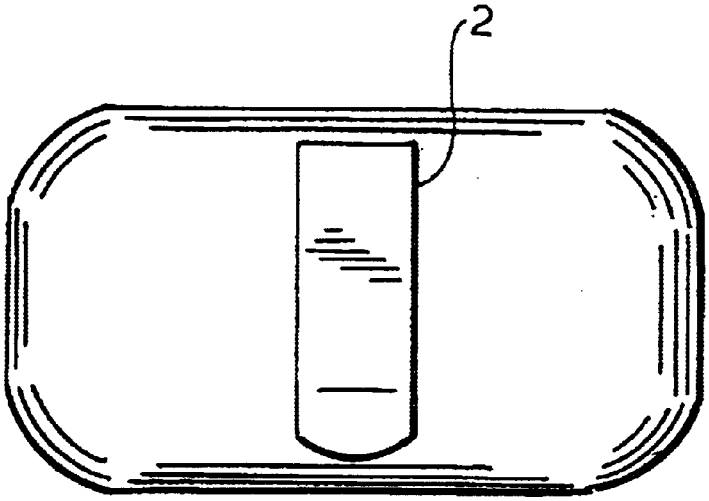
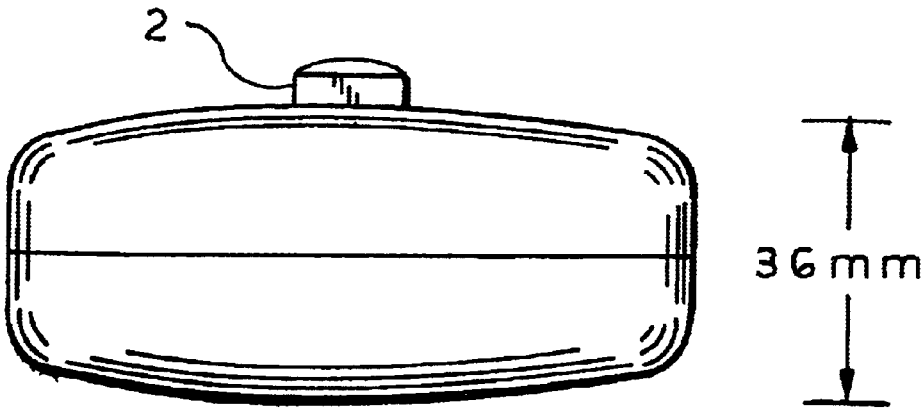
FIG. 4

FIG. 5
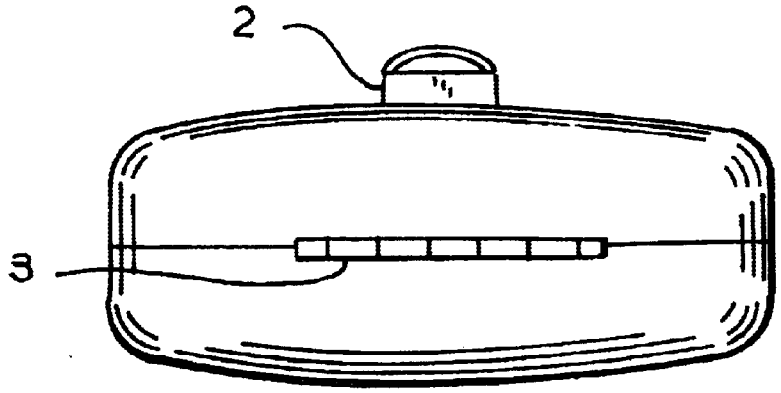
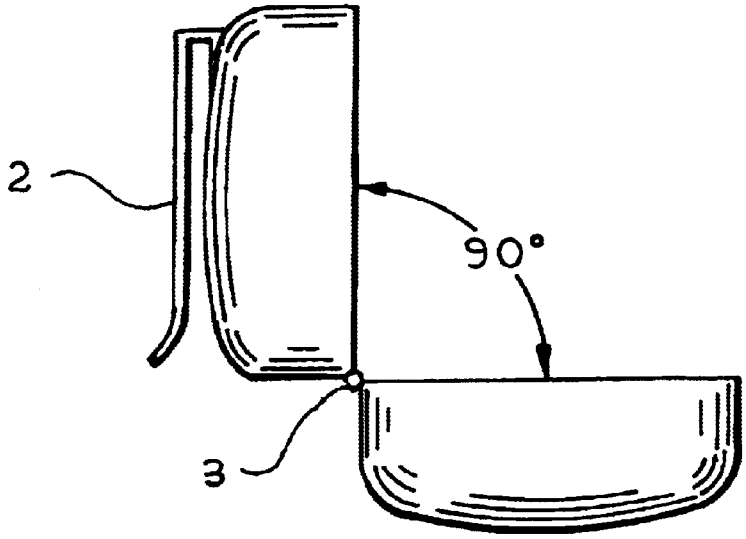
FIG. 6

DETACHABLE MULTI-MOUNTING COMPACT GOLF ACCESSORY ORGANIZER

CROSS REFERENCE TO RELATED APPLICATIONS

Not Applicable

STATEMENT REGARDING FED SPONSORED R & D

Not Applicable

STATEMENT REGARDING FEDERALLY SPONSORED R & D

Not Applicable

REFERENCE TO A MICROFICHE APPENDIX

Not Applicable

BACKGROUND OF THE INVENTION a. Field of the Invention

The present invention relates to devices for organizing golf accessories. This invention specifically relates to devices intended to allow a golfer to organize golf accessories normally carried in a golfer's pocket or golf bag for example, golf tees, ball markers, and the like.

b. Description of the Prior Art

Prior inventions of golf accessories are listed below:

1. U.S. Pat. No. 4,993,614 to Bonofiglo is for a golf accessory organizer that is mounted on a belt only and to be worn around the waist of the user such as a tool belt for construction tools. This device is mounted on the belt and can only be used as a whole. It can only be attached to the waist of the user and no other place. It is large and cumbersome.
2. U.S. Pat. No. 5,269,410 to Abregano also relates to a golf accessory organizer. This device has various compartments for storing golf accessories. This device is actually a small bag that attaches only to the top of the golf bag.
3. U.S. Pat. No. 6,202,911 to Freer is a golf accessory organizer that is used to store golf accessories that attaches to the belt of the user. This device is very similar to Bonofiglo's organizer. Freer and Bonofiglo's organizers attach by looping the belt through the handles at the back of the item. The organizer is large in size and hangs down low from the belt interfering with walking, sitting and the golfers swing.
4. U.S. Des. Pat. No. 393,948 to Cowlen is a golf accessory fanny pack or belt. This is again fastened to the top portion of a golf bag. It has a net for storing golf accessories and has a specified space for a water bottle.
5. U.S. Pat. No. 5,199,573 to Gribovsky relates to a golf accessory organizer. This organizer is a multi-fold wallet intended to be carried in the pocket of the user. It has storage space for a notepad, a golf score card, a golf score pencil, and a divot repair tool. It is smaller then previous inventions but is mainly intended for keeping score while playing golf
6. U.S. Pat. No. 4,804,121 to Stanton et al., is similar to the Cowlen patent discussed above. This device has storage pockets that are not specific to any particular purpose or item. These pockets are designed to be multipurpose and to be carried on the golf bag.

There is a need for a compact golf accessory organizer that can be attached to many different articles not limited to a golf bag or a belt that can be used to store articles that are normally carried in a golfer's pocket or golf bag. Prior art devices previously mentioned store these items on a golf bag or are attached to the golfer's belt. This can be inconvenient because the golfer and his golf bag are often separated and large objects around the belt area can obstruct the golfer's swing. In these cases the accessories stored in the golf bag are either not accessible to the golfer or are uncomfortable and cumbersome.

BRIEF SUMMARY OF THE INVENTION

The present invention provides a means of storage for the various accessories often used by a golfer. Additionally, it is an object of the invention to provide a means of storage for golf accessories that is multi-mounting. The general areas for mounting include golfer's golf bag, golf cart visor, clothing waistband, belt, pockets, and the like.

The compact organizer contains a vac-form with impressions that mold around the included articles. This is specifically designed to only hold the following articles: four tees, two ball markers, and a universal tool which consists of a divot repair, a spike tightening device, a club cleaner and a cigar holder.

The compact organizer has an additional feature for the universal tool along with the vac-form impression. There is a magnet on the underside of the impression that better retains the universal tool without using elastic straps or Velcro as with prior inventions.

The compact size of the organizer measures approximately 84.5 mm×48 mm×36 mm making it smaller than an average pager. This invention will be the smallest golf accessory organizer in the market. Supporting our claim that the present invention is less cumbersome than all present inventions of golf organizers.

BRIEF DESCRIPTION OF THE DRAWINGS

The following description of the accessory will provide a better in depth understanding of its parts and various functions. The drawings will outline individual sections of the article and its purposes as relating to golf accessories. The references made are as follows:

FIG. 1 is a front closed view of the present invention.

FIG. 2 is a side closed view of the present invention.

FIG. 3 is a back closed view of the present invention.

FIG. 4 is a top closed view of the present invention.

FIG. 5 is a bottom closed view of the present invention.

FIG. 6 is a open side view of the present invention.

DETAILED DESCRIPTION OF THE INVENTION

FIG. 1 is a front closed perspective view of the compact golf accessory organizer carrying apparatus. The size of the case measures at 84.5 mm×48 mm×36 mm making it compact enough to fit on the waist of the golfer without discomfort or obstruction to the golfers natural swing.

The organizer is a steel metal case covered in leather; however, it can be covered in other appropriate material including fabric, plastic, plating or a painted finish. The logo panel (1) is located on the front of the organizer providing space for the advertiser's name, logo, address and telephone number if desired.

FIG. 2 is side closed perspective view of compact golf accessory organizer showing the positioning of the multi-mounting clip (2). The apparatus comprises of a multi-mounting clip that is concealed from the view of an onlooker. The multi-mounting clip is made of metal; making it durable and resistant to wear and tear. It is painted to prevent rusting or discoloration of the steel metal. The clip enables the apparatus to be attached on to a surface including but not limited to a golfers golf bag, golf cart visor, clothing waistband, belt, pockets, and the like.

FIG. 3 is a closed back perspective view of the compact golf accessory organizer. This presents the back view of the multi-mounting clip (2). This view is concealed from the view of an onlooker unless it is detached from the surface.

FIG. 4 is a closed top perspective view of the compact golf accessory organizer. This is the view the golfer will have if the accessory was placed on the waistband of the golfer when looking down.

FIG. 5 is a closed bottom perspective view of the compact golf accessory organizer. The metal spring hinge mechanism of the accessory (3) can be seen from this view. The metal hinge has been plated to prevent rusting and discoloration to the steel metal. It could also be painted to provide the same function.

FIG. 6 is an open side perspective view of the compact golf accessory organizer. This view allows you to see the 90° angle or L-shape of the organizer.

Figure 7:
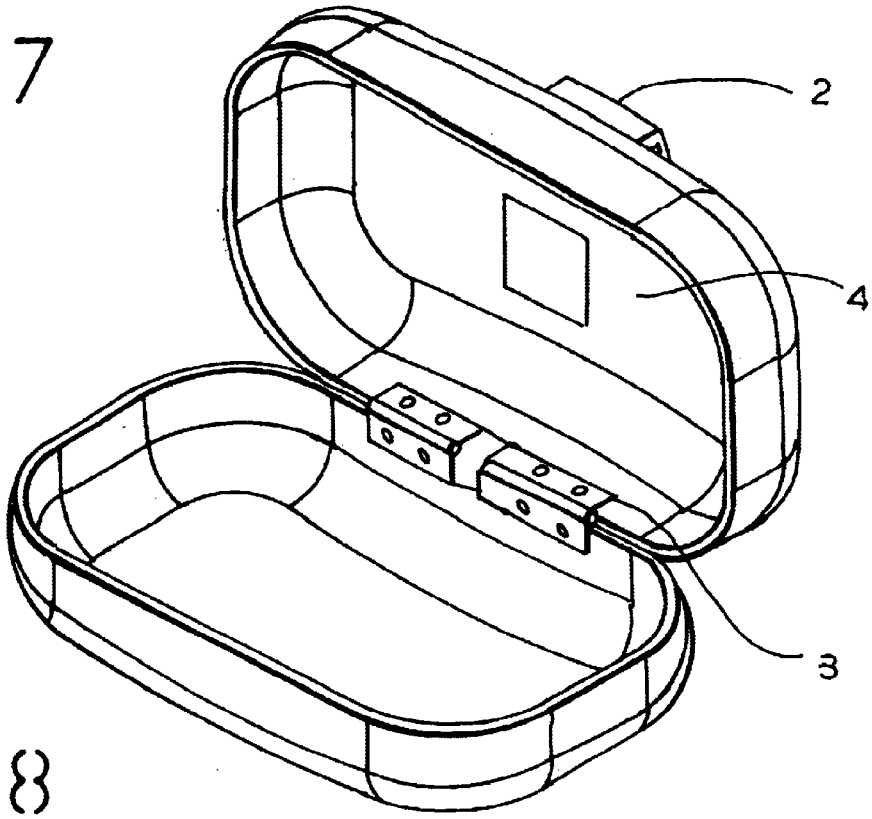
FIG. 7 is a front/side open view without vac-form and accessory items of the present invention.

FIG. 7 is an open front/side perspective view of the compact golf accessory organizer showing the inside of the organizer. The view clearly shows the hollow shell of the organizer without the vac-form insert or the items. The metal shell is cut out of steel metal sheeting, and then compressed in a mold to form the shape of the organizer. The multi-mounting clip (2) is welded in the area marked (4) permanently attaching it.

This view also shows the closing mechanism on the compact golf accessory organizer that is a metal spring hinge (3) that eases the opening and closing of the case. When opened the organizer displays the articles at a 90° angle or L-shape, making it easy for the user to locate the items. A golfer can access the apparatus with one hand only. The spring hinge (3) ensures that the case is securely closed without the possibility of any articles dropping or falling out.

Figure 8:
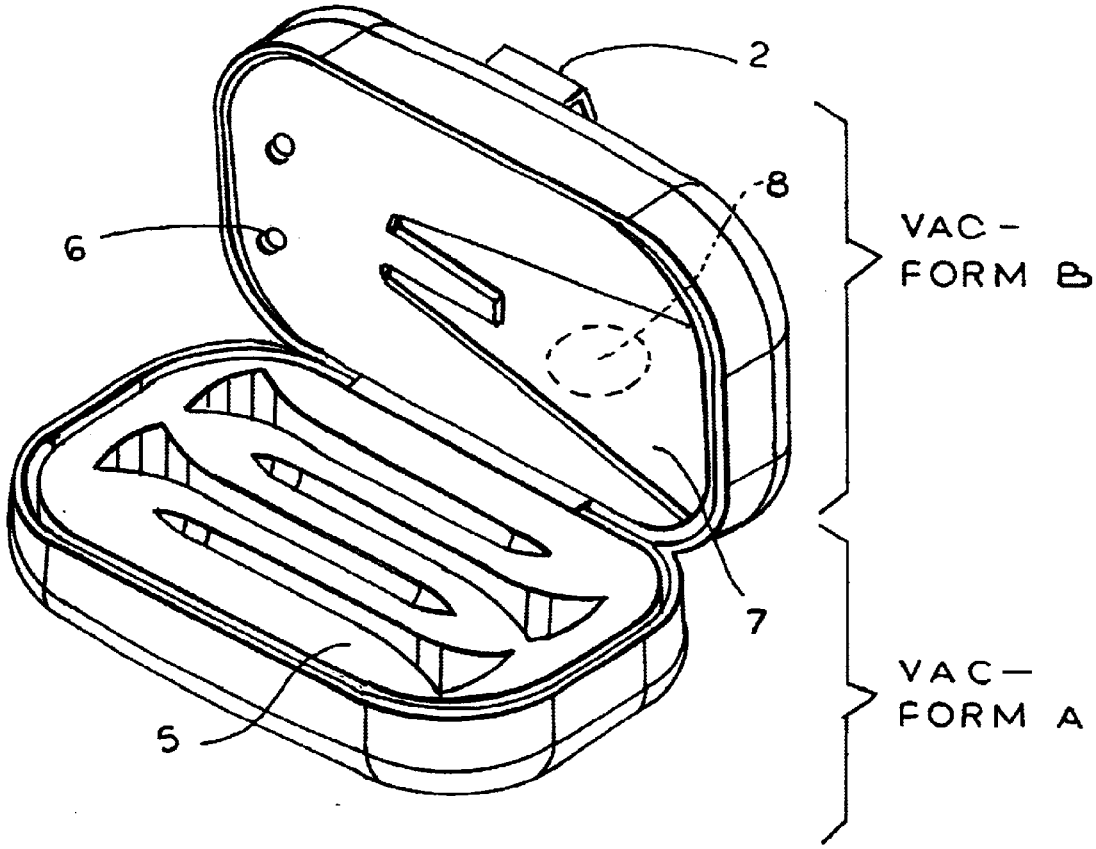
FIG. 8 is a front/side open view without accessory items of the present invention.

FIG. 8 is an open front/side perspective view of the compact golf accessory organizer. There are two vac-forms on the inside of the case (A) and (B). These vac-forms are made from styrene and are covered in flocking.

In vac-form (A), there are 4 impressions (5) to specifically fit 4 golf tees. The impressions allow the tees to fit securely into the designated space. The tees are held in place by the impressions of the vac-form that organizes the location of each individual tee minimizing the chances of misplacing them.

In vac-form (B), there are two impressions (6) for the two ball markers and one impression (7) for the universal tool.

On the left side of this figure are the two ball marker impressions (6). The impression holds the ball markers securely in place and organizing it to allow easy access for the user.

On the right side of this is an impression (7) to hold the universal tool. The vac-form (B) has a magnet (8) on the underside to allow easy removal by sliding the tool outward. The magnet also secures the tool to the vac-form when stored. The magnet ensures that the tool fits securely into the vac-form without falling out when being opened.

Figure 9:
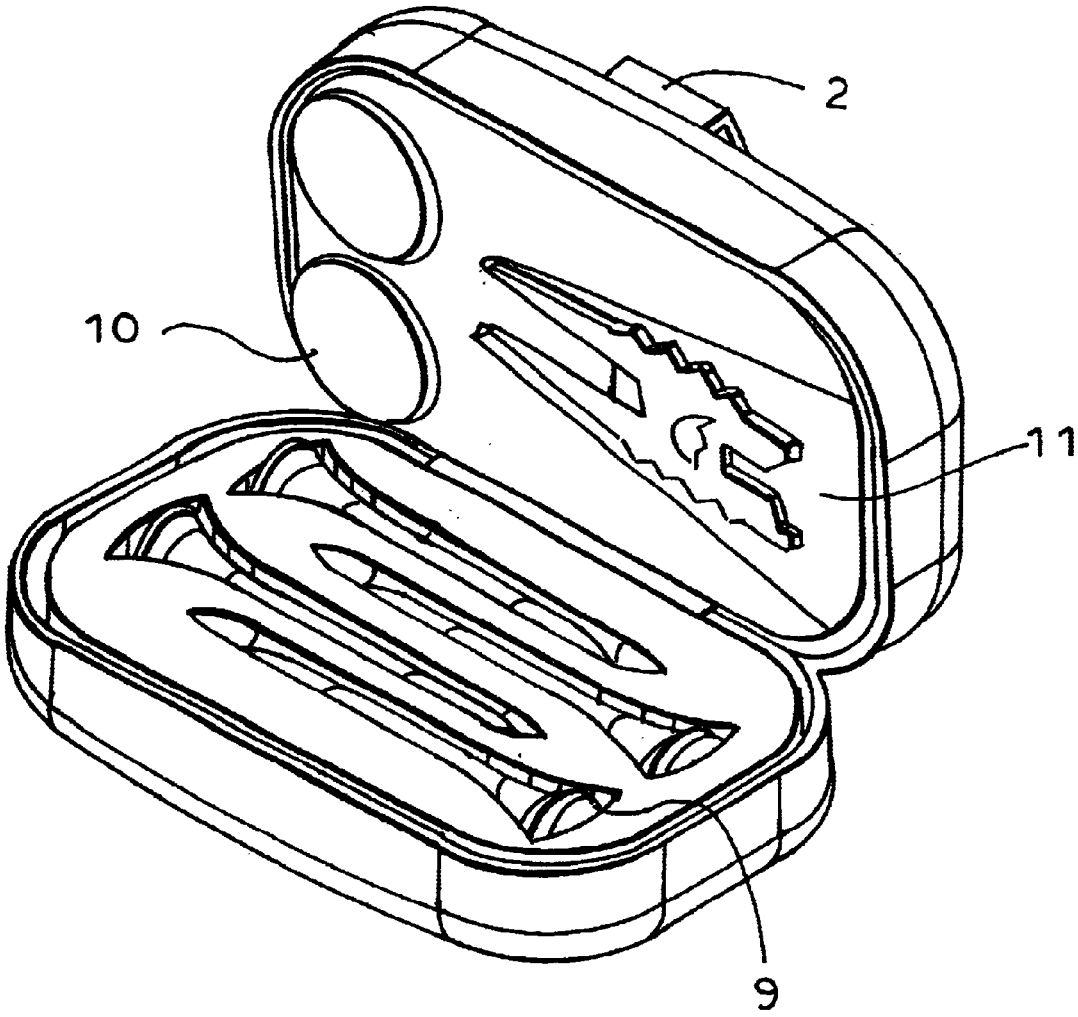
FIG. 9 is a front/side open view with accessory items of the present invention.

FIG. 9 is a front/side open view with accessory items of the present invention showing the position and division of the different articles included. The accessories include four golf tees (9), two golf ball markers (10), and one universal golf tool (11). This universal tool is made of metal and has a logo impression. It functions as divot repair, a spike tightening device, a club cleaner and a cigar holder. All the items are attached securely in their designated positions by the vac-form impressions.

I claim:

1. A golf accessory organizer comprising of:

a. a compact metal case measuring 84.5 mm×48 mm×36 mm;

b. a means for attaching said case to a golfer's golf bag, a golf cart visor, a clothing waistband, a belt or a pocket;

c. a logo panel;

d. golf accessories:

e. an accessory vac-form with impressions shaped to receive said golf accessories;

f. a closing mechanism consisting of a spring hinge; and g. a magnet situated on the underside of said vac-form in alignment with one of said impressions.

2. The organizer of claim 1 wherein said attaching means comprises a universal functioning clip attached to a back side of said case.

3. The organizer of claim 1, wherein said golf accessories comprise golf ball markers and wherein said vac-form. comprises impressions shaped to receive said golf ball markers.

4. The organizer of claim 1 wherein said golf accessories comprise a universal tool and wherein one of said impressions is shaped to receive said tool.

5. The organizer of claim 4 wherein said tool comprises divot repair means, spike tightening means, club cleaner means and a cigar holder.

6. The organizer of Class 1 wherein said golf accessories comprise golf tees and said case comprises a second vac-form with impressions shaped to receive said golf tees.

7. The organizer of claim 6 wherein said golf accessories comprise four golf tees and said second vac-form comprises four impressions shaped to receive said four golf tees, respectively.

8. A golf accessory organizer comprising a plurality of golf accessories including a tool, a case, said case comprising a top, a bottom and means for hingeably connecting said top and said bottom, a magnet, a vac-form situated within said case and having a side with recesses shaped to receive at least some of said golf accessories, including said tool, and an underside, said magnet being situated adjacent said underside of said vac-form in alignment with said recess shaped to receive said tool and clip means for attaching case to another object.

9. The organizer of claim 8 further comprising a second vac-form having recesses shaped to receive at least some of said golf accessories.

10. The organizer of claim 8 wherein said golf accessories comprise golf ball markers.

11. The organizer of claim 9 wherein said golf accessories comprise golf ball tees.

* * * * *